US011774041B2

(12) United States Patent
Ma et al.

(10) Patent No.: US 11,774,041 B2
(45) Date of Patent: Oct. 3, 2023

(54) INTEGRAL SIDE SLOPE STRUCTURE OF SOIL COVERING TANK

(71) Applicants: SHANDONG CHAMBROAD HOLDING GROUP CO., LTD., Binzhou (CN); SHANDONG CHAMBROAD EQUIPMENT MANUFACTURE INSTALLATION CO., LTD., Binzhou (CN)

(72) Inventors: Yunsheng Ma, Binzhou (CN); Liqiu Zhao, Binzhou (CN); Ziping Zhang, Binzhou (CN); Chenghe Zhang, Binzhou (CN); Qingsong Zhao, Binzhou (CN); Chongchong Zhang, Binzhou (CN); Jiatao Cheng, Binzhou (CN); Shengke Wei, Binzhou (CN); Xingfei Geng, Binzhou (CN)

(73) Assignees: SHANDONG CHAMBROAD HOLDING GROUP CO., LTD., Binzhou (CN); SHANDONG CHAMBROAD EQUIPMENT MANUFACTURE INSTALLATION CO., LTD., Binzhou (CN)

( * ) Notice: Subject to any disclaimer, the term of this patent is extended or adjusted under 35 U.S.C. 154(b) by 0 days.

(21) Appl. No.: 17/998,441

(22) PCT Filed: Apr. 12, 2021

(86) PCT No.: PCT/CN2021/086665
§ 371 (c)(1),
(2) Date: Nov. 10, 2022

(87) PCT Pub. No.: WO2022/141932
PCT Pub. Date: Jul. 7, 2022

(65) Prior Publication Data
US 2023/0184379 A1 Jun. 15, 2023

(30) Foreign Application Priority Data
Dec. 31, 2020 (CN) ..... 202011637542.1

(51) Int. Cl.
*E04H 7/02* (2006.01)
*F17C 13/12* (2006.01)
(Continued)

(52) U.S. Cl.
CPC ..... *F17C 1/007* (2013.01); *B65D 88/76* (2013.01); *E04H 7/02* (2013.01); *F17C 13/12* (2013.01);
(Continued)

(58) Field of Classification Search
CPC ..... E04H 7/02; E02D 17/18; E02D 17/20; E02D 17/202; E02D 27/38; B65D 88/76;
(Continued)

(56) References Cited

U.S. PATENT DOCUMENTS

2006/0285927 A1* 12/2006 Hisgrove ..... B65D 88/76 220/23.91
2023/0134488 A1* 5/2023 Ma ..... E02D 27/38 405/53

FOREIGN PATENT DOCUMENTS

CN 101852031 A 10/2010
CN 103486441 A 1/2014
(Continued)

OTHER PUBLICATIONS

PCT/CN2021/086665—International Search Report, dated Aug. 25, 2021, 3 pages.
(Continued)

*Primary Examiner* — Frederick L Lagman
(74) *Attorney, Agent, or Firm* — Getech Law LLC; Jun Ye

(57) ABSTRACT

An integral side slope structure of a soil-covered tank, includes a tank body, connecting pieces, and reinforcing
(Continued)

frameworks. The exterior of the tank body is completely covered with soil, and a side slope is formed after the tank body is covered with the soil; each connecting piece is composed of ribs which are in cross connection to each other; the connecting pieces are connected to the outer wall of the tank body and are laid inside the side slope in the horizontal direction; a single-layer connecting net is formed after a single layer of the connecting pieces is connected to the tank body; a plurality of layers of the connecting pieces are arranged at intervals in the vertical direction; the tank body and the side slope are connected by the multi-layer connecting net to form an integral structure; the reinforcing frameworks are arranged along the side slope.

9 Claims, 4 Drawing Sheets

(51) Int. Cl.
*B65D 88/76* (2006.01)
*F17C 1/00* (2006.01)

(52) U.S. Cl.
CPC ..... *F17C 13/126* (2013.01); *F17C 2203/011* (2013.01); *F17C 2205/0107* (2013.01); *F17C 2221/035* (2013.01)

(58) Field of Classification Search
CPC ..... B65D 90/22; F17C 1/007; F17C 13/12; F17C 13/126
See application file for complete search history.

(56) References Cited

FOREIGN PATENT DOCUMENTS

| | | | |
|---|---|---|---|
| CN | 104612167 | A | 5/2015 |
| CN | 204530724 | U | 8/2015 |
| CN | 205444209 | U | 8/2016 |
| CN | 106760577 | A | 5/2017 |
| CN | 206521949 | U | 9/2017 |
| CN | 109854051 | A | 6/2019 |
| CN | 111425753 | A | 7/2020 |
| CN | 212025796 | U | 11/2020 |
| FR | 2712956 | A1 | 6/1995 |

OTHER PUBLICATIONS

CN 202011637542.1—First Office Action, dated Jun. 23, 2021, 14 pages. (with English translation).
CN 202011637542.1—Notice of Allowance, dated Sep. 10, 2021, 7 pages. (with English translation).

* cited by examiner

INTEGRAL SIDE SLOPE STRUCTURE OF SOIL COVERING TANK

CROSS REFERENCE OF RELATED APPLICATIONS

This is a 371 of International Application No. PCT/CN2021/086665, filed Apr. 12, 2021 which claims priority from Chinese Patent Application No. 202011637542.1, filed on Dec. 31, 2020, the contents of the aforementioned applications are herein incorporated by reference in their entireties.

FIELD

The present disclosure relates to a technical field of soil-covered tanks, in particular to an integral side slope structure of a soil covered tank.

BACKGROUND

Soil covering storage means that a liquefied petroleum gas at a normal temperature is pressurized and stored in tanks or under the ground and is subjected to reasonable comprehensive backfill, this technology is very suitable for storing a flammable and explosive liquid material and can be used for protecting tank bodies, preventing heat and shock waves generated by combustion and explosion from affecting other tank bodies, effectively reducing risks and ensuring that the tank bodies are mounted closer to one another, thereby saving the land. At present, a technology for tank bodies completely covered with soil has not been mature; at abroad, mainly adopted is a half-layer soil covering technology by which the upper layer of the tank body is covered with soil and the bottom of the tank body is provided with a supporting member; however, in view of safety, the advantages of complete covering of soil are more obvious, but a side slope formed around after the complete covering of soil is greater, and a stress condition of an overall soil-covered structure is more complex. In order to improve the stability of the soil-covered structure, what can be referenced in the prior art is to only construct an arched concrete frame similar to a side slope of a highway on the side slope or to grow vegetation on the side slope. However, existing side slope protection measures are based on the highway of which the soil layer has a different compaction factor and soil texture condition as compared with covering soil for the tank body, and therefore, the soil layer is not completely suitable for direct application to a soil-covered side slope of the tank body. After the exterior of the tank body is completely covered with soil, the integrity and connectivity of the existing soil-covered side slope structure are not high on the premise that the cost is taken into account, and therefore, the problem about side slope drift easily occurs due to influences from various external factors during later use.

SUMMARY

The present application provides an integral side slope structure of a soil covered tank, by which the problem about side slope shift affected by external factors is solved.

The present application adopts the following technical solutions.

The present application provides an integral side slope structure of a soil covered tank, including a tank body, connecting pieces, and reinforcing frameworks. An exterior of the tank body is completely covered with soil, and a side slope is formed after the tank body is covered with the soil; each connecting piece is composed of ribs which are in cross connection to each other; the connecting pieces are connected to an outer wall of the tank body and are laid inside the side slope in the horizontal direction; a single-layer connecting net is formed after a single layer of the connecting pieces is connected to the tank body; a plurality of the single-layers of the connecting pieces are arranged at intervals in the vertical direction, so that a multi-layer connecting net connected to the tank body is formed in the side slope; the tank body and the side slope are connected by the multi-layer connecting net to form an integral structure; and the reinforcing frameworks are arranged along the side slope; the side wall of each reinforcing framework is provided with an extension rod; the extension rod extends and is inserted into the side slope; the connecting piece close to the reinforcing framework is provided with a matching hole; and the extension rod penetrates through the matching hole of the connecting piece, so that a cross structure is formed between the side slope and the connecting piece.

The reinforcing frameworks are arranged on the side slope, so that the problem that the side slope is corroded to collapse due to external factors can be avoided, and then, the situation that slip of covering soil on the side slope occurs on the side slope is avoided. The side wall of each reinforcing framework is provided with the extension rod, and the extension rod extends and is inserted into the side slope, so that the tightening effect of the reinforcing framework on covering soil near the reinforcing framework can be effectively enhanced, then, the situation that the tank body is exposed in the air due to the collapse of the covering soil on the side slope is avoided, the situation that the tank body is exposed in the air and is corroded by environmental factors such as air and rainwater so as to be rusty is avoided, the tank body can be prevented from being leaked, environment pollution caused by leakage of matters stored in the tank body is avoided, a threat brought by explosion caused by the leakage of the matters to the personal safety of working staff and the safety of a plant area is avoided, and property loss is avoided. The reinforcing frameworks and the outer wall of the tank body are connected by the connecting pieces, the plurality of layers of connecting pieces are arranged at intervals in the vertical direction, the plurality of reinforcing frameworks are arranged, the plurality of reinforcing frameworks are arranged on the side slope formed after the tank body is covered with soil, and then, covering soil is consolidated under the combined action of the tank body, the reinforcing frameworks, and the connecting pieces, so that the covering soil becomes tighter. Each connecting piece is composed of the ribs which are in cross connection to each other, the covering soil surrounding the connecting pieces can enter gaps among the ribs which are in cross connection to each other, and thus, the tightness of connection between the connecting piece and the covering soil can be increased. After the covering soil is compacted, the reinforcing frameworks, the connecting pieces, the tank body, the covering soil near the connecting pieces and the covering soil near the reinforcing frameworks form the integral structure, and thus, the stability of the tank body is guaranteed. When the tank body is stressed nonuniformly and the stable state is destroyed, due to the combined action of the covering soil, the connecting pieces, and the reinforcing frameworks, the tank body can be effectively prevented from being inclined, the situation that the matters stored in the tank body are leaked due to the inclination of the tank body is avoided, the problem about production safety is avoided, and meanwhile, the property loss can be effectively reduced. Meanwhile, the tank body, the reinforcing frameworks and the connecting pieces can play a role as frameworks in the covering soil, so that the covering soil is effectively prevented from collapsing, other situations such as overturning of the tank body are avoided, and the problem about production safety is avoided. The connecting pieces are connected to the tank body and the reinforcing frameworks, so that the situation that the reinforcing frameworks slip from the side slope can be effectively avoided, and then, the reinforcing frameworks are prevented from destroying the stability of the covering soil on the side slope.

In an implementation of the present application, a spacing distance of the connecting pieces in the vertical direction is 0.4-0.8 m.

In an implementation of the present application, the connecting pieces are set as steel-plastic geogrids.

In the present application, the connecting pieces are the steel-plastic geogrids, so that the connecting pieces can resist to corrosive effects of water and chemical elements from the covering soil on the connecting pieces, the situation that the fixing effects of the connecting pieces on the reinforcing frameworks are lowered due to the fracture of the connecting pieces is avoided, and meanwhile, the effect of connection between each connecting piece and the covering soil is prevented from being lowered. The steel plastic geogrids are of porous structures, so that the extension rods of the reinforcing frameworks are more easily combined with the connecting pieces, then, the construction difficulty is lowered, and the production efficiency is increased.

In an implementation of the present application, a plurality of fixing pieces are arranged on the outer wall of the tank body, and the fixing pieces are used to be connected to the connecting pieces; and the fixing pieces are arranged to be single-layer at intervals around the outer wall of the tank body and are arranged to be multi-layer at intervals in the vertical direction of the outer wall of the tank body.

In an implementation of the present application, the fixing piece is a pothook, and the pothook penetrate through the gap among the ribs of the connecting pieces.

In the present application, by arranging the pothooks, the pothooks are connected by penetrating through the gaps among the ribs of the connecting pieces, so that the construction difficulty can be lowered, the labor intensity of workers can be relieved, and then, the construction efficiency can be increased.

In an implementation of the present application, the steel-plastic geogrids are in mutually-bound connection to form the single-layer connecting net around the tank body.

In the present application, by adopting the way that the steel-plastic geogrids are in mutually-bound connection to form the single-layer connecting net around the tank body, all the connecting pieces, the reinforcing frameworks and the tank body form the integral structure, so that the effect on tightening the covering soil can be improved.

In an implementation of the present application, the matching hole is defined by crossing the ribs of each connecting piece so that the extension rod of each reinforcing framework penetrates among the ribs of the connecting piece.

The extension rod penetrates among the ribs of each connecting piece, by which the labor intensity of constructors can be relieved, the construction difficulty can be lowered, and thus, the production efficiency is increased.

In an implementation of the present application, the extension rod and the reinforcing framework are arranged at a 90° included angle, the side slope has a first inclination angle, and if the reinforcing framework is arranged on the side slope, the extension rod is inserted into a soil layer, so that an oblique insertion connection state is formed among the extension rod, the soil layer, and the connecting piece.

In the present application, by arranging the extension rod and the reinforcing framework at the 90° included angle, the difficulty in inserting the extension rod into the covering soil can be lowered, the extension rod can be inserted into the covering soil more simply, and thus, the construction difficulty is lowered. The side slope has the first inclination angle, and after the reinforcing framework is arranged on the side slope, the extension rod is inserted into the soil layer, so that the oblique insertion connection state is formed among the extension rod, the soil layer, and the connecting piece, in this way, the tightness of connection among the reinforcing framework, the extension rod and the covering soil can be increased, and thus, the covering soil is prevented from sinking.

In an implementation of the present application, a plurality of reinforcing frameworks are arranged and are uniformly distributed at intervals in the horizontal and height directions of the side slope respectively, so that the extension rod of the single reinforcing framework at least penetrates through the connecting piece of the single-layer connecting net.

By adopting the way that a plurality of reinforcing frameworks are arranged and are uniformly distributed at intervals in the horizontal and height directions of the side slope respectively, the tightness of combination between the reinforcing framework and the covering soil on the side slope can be increased, the coverage area is increased, and the situation that the tank body is corroded since the covering soil on the side slope slips is avoided. By adopting the way that the extension rod of the single reinforcing framework at least penetrates through the connecting piece of the single-layer connecting net, the tightness of the reinforcing frameworks and the connecting pieces can be increased, so that the effect that the connecting pieces and the reinforcing frameworks are combined with the covering soil can be improved, and the covering soil on the side slope is prevented from slipping.

In an implementation of the present application, each of the reinforcing frameworks is provided with four extension rods which are symmetrically arranged around the reinforcing framework respectively, the reinforcing framework is arranged on the side slope, the two extension rods arranged on an upper part of the reinforcing framework penetrate through the connecting piece on one layer, and the two extension rods arranged on a lower part of the reinforcing framework penetrate through the connecting piece on the other layer, so that the same reinforcing framework is connectable to two layers of connecting pieces at the same time.

In the present application, the connecting pieces which are spaced from each other in the vertical direction are connected by the extension rod connected to one of the reinforcing framework, so that the integral effect of the reinforcing frameworks, the connecting pieces, the covering soil and the tank body is improved, the effect on fixing the tank body is improved, the tank body is prevented from being overturned, and the effect on tightening the covering soil is improved.

BRIEF DESCRIPTION OF THE DRAWINGS

The accompanying drawings described herein are provided for further understanding of the present application, and constitute one part of the present application. Exemplary embodiments of the present application and their descriptions are intended to explain the present application, rather than to constitute improper limitations on the present application. In the accompanying drawings.

In the drawings.

Figure 1:
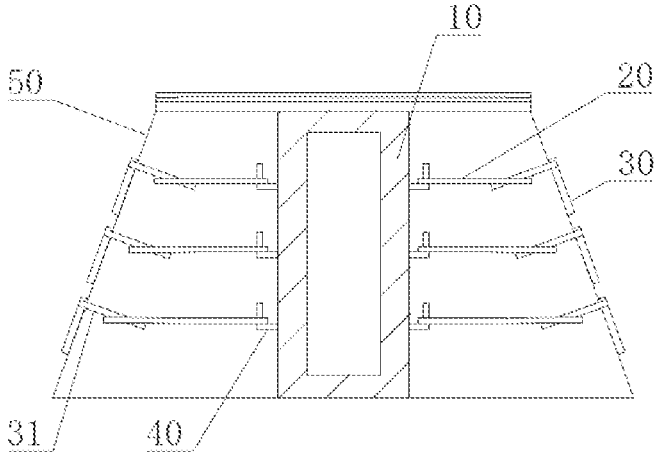
FIG. 1 is a schematic structural view of an exemplary implementation in the present application.

10—tank body; 20—connecting piece; 21—matching hole; 30—reinforcing framework; 31—extension rod; 40—pothook; and 50—side slope.

DETAILED DESCRIPTION OF THE EMBODIMENTS

In order to make the objectives, technical solutions and advantages of the present application clearer, the technical solutions of the present application will be clearly and completely described below with reference to the specific implementations and the corresponding accompanying drawings of the present application. All of other embodiments obtained by the ordinary skill in the art on the basis of the implementations of the present application without paying creative work fall within the protection scope of the present application.

As shown in FIG. 1 to FIG. 6, in this implementation, the present application provides an integral side slope structure of a soil covered tank, the integral side slope structure includes a tank body 10, connecting pieces 20, and reinforcing frameworks 30. An exterior of the tank body 10 is completely covered with soil, and a side slope 50 is formed after the tank body 10 is covered with the soil; each connecting piece 20 is composed of ribs which are in cross connection to each other; the connecting pieces 20 are connected to an outer wall of the tank body 10 and are laid inside the side slope 50 in the horizontal direction; a single-layer connecting net is formed after a single layer of the connecting pieces 20 is connected to the tank body 10; a plurality of the single layers of the connecting pieces 20 are arranged at intervals in the vertical direction, so that a multi-layer connecting net connected to the tank body 10 is formed in the side slope 50; the tank body 10 and the side slope 50 are connected by the multi-layer connecting net to form an integral structure; and the reinforcing frameworks 30 are arranged along the side slope 50; a side wall of each reinforcing framework 30 is provided with an extension rod 31; the extension rod 31 extends and is inserted into the side slope 50; the connecting piece 20 close to the reinforcing framework 30 is provided with a matching hole 21; and the extension rod 31 penetrates through the matching hole 21 of the connecting piece 20, so that a cross structure is formed between the side slope 50 and the connecting piece 20.

The reinforcing frameworks 30 are arranged on the side slope 50, so that the problem that the side slope 50 is corroded to collapse due to external factors can be avoided. The side wall of each reinforcing framework 30 is provided with the extension rod 31, and the extension rod 31 extends and is inserted into the side slope 50, so that the tightening effect of the reinforcing framework 30 on covering soil near the reinforcing framework 30 can be effectively enhanced, then, the situation that the tank body 10 is exposed in the air due to the collapse of the covering soil on the side slope 50 is avoided, the situation that the tank body 10 is exposed in the air and is corroded by air so as to be rusty is avoided, the tank body 10 can be prevented from being leaked, environment pollution caused by leakage of matters stored in the tank body 10 is avoided, a threat brought by explosion caused by the leakage of the matters to the personal safety of working staff and the safety of a plant area is avoided, and property loss is avoided. The reinforcing frameworks 30 and the outer wall of the tank body 10 are connected by the connecting pieces 20, the plurality of layers of connecting pieces 20 are arranged at intervals in the vertical direction, the plurality of reinforcing frameworks 30 are arranged, the plurality of reinforcing frameworks 30 are arranged on the side slope 50 formed after the tank body 10 is covered with soil, and then, covering soil is consolidated under the combined action of the tank body 10, the reinforcing frameworks 30, and the connecting pieces 20, so that the covering soil becomes tighter. Each connecting piece 20 is composed of the ribs which are in cross connection to each other, the covering soil surrounding the connecting pieces 20 can enter gaps among the ribs which are in cross connection to each other, and thus, the tightness of connection between the connecting piece 20 and the covering soil can be increased. The connecting pieces 20 are laid inside the side slope 50 in the horizontal direction, the plurality of layers of connecting pieces 20 are arranged at intervals in the vertical direction, so that the multi-layer connecting net connected to the tank body 10 is formed in the side slope 50, and then, the contact area between each connecting piece 20 and the covering soil is increased. The connecting piece 20 close to the reinforcing framework 30 is provided with the matching hole 21, and the extension rod 31 penetrates through the matching hole 21 of the connecting piece 20, so that the cross structure is formed between the side slope 50 and the connecting piece 20, and the tank body 10 and the side slope 50 are connected by the multi-layer connecting net to form the integral structure. After the covering soil is compacted, the reinforcing frameworks 30, the connecting pieces 20, the tank body 10, the covering soil near the connecting pieces 20 and the covering soil near the reinforcing frameworks 30 form the integral structure, so that the covering soil on the side slope 50 is prevented from slipping, and the stability of the tank body 10 is guaranteed. When the tank body 10 is stressed nonuniformly and the stable state is destroyed, the tank body 10 is connected to the reinforcing frameworks 30 and the connecting pieces 20, a unidirectional unbalanced force is uniformly dispersed by the reinforcing frameworks 30 and the connecting pieces 20 arranged around the tank body 10 to act on the covering soil, the tank body 10 is connected to the reinforcing frameworks 30 via the connecting pieces 20, the motion of the tank body 10 is stopped under the action of a force for connecting the connecting pieces 20 and the reinforcing frameworks 30 to the covering soil, and meanwhile, the situation of covering soil collapse caused by the unidirectional unbalanced force from the tank body is avoided. Due to the combined action of the covering soil, the multi-layer connecting net connected to the tank body 10 and formed by the plurality of layers of connecting pieces 20 in the side slope 50 and the plurality of reinforcing frameworks 30, the tank body 10 can be effectively prevented from being inclined, the situation that the matters stored in the tank body 10 are leaked due to the inclination of the tank body 10 is avoided, the problem about production safety is avoided, and meanwhile, the property loss can be effectively reduced. Meanwhile, a structure formed by connection among the tank body 10, the reinforcing frameworks 30 and the connecting pieces 20 can play a role as a framework in the covering soil, so that the covering soil is fixed, the covering soil is effectively prevented from collapsing, the stability of the covering soil can be guaranteed, the situation that the tank body 10 is overturned due to unbalanced stress caused by covering soil collapse on the tank body 10 is avoided, and the problems about environment pollution and the safety of a plant area caused by the leakage of the matters stored in the tank body 10 are avoided. Moreover, by forming the integral structure from the reinforcing frameworks 30, the connecting pieces 20, the tank body 10, the covering soil near the connecting pieces 20 and the covering soil near the reinforcing frameworks 30, the problem that the covering soil on the side slope 50 slips can be effectively avoided, so that the situation that the covering soil forms an obstacle on a road to cause a traffic problem is avoided, meanwhile, safety threat brought for pedestrians by the covering soil can also be avoided, and the problem about production safety is avoided. The connecting pieces 20 are connected to the tank body 10 and the reinforcing frameworks 30, so that the situation that the reinforcing frameworks 30 slip from the side slope 50 can be effectively avoided, then, the reinforcing frameworks 30 are prevented from destroying the stability of the covering soil on the side slope 50, and the problem of potential safety hazards caused by the slip of the covering soil on the side slope 50 is avoided. In the present application, due to the arrangement of the reinforcing frameworks 30 and the connecting pieces 20, the tightness of connection between the covering soil and the tank body 10 is enhanced; and due to the arrangement of a connecting structure of the reinforcing frameworks 30, the connecting pieces 20, and the tank body 10, the effect on fixing the covering soil is enhanced, the problem that the covering soil slips is avoided, and then, the effect that the tank body 10 is protected by the covering soil is enhanced. The covering soil can effectively prevent the tank body 10 from being damaged by external factors such as impact and temperature, so that the production safety is guaranteed, the matters stored in the tank body 10 are prevented from being leaked, and the problem about environment pollution is avoided. When it is rainy, the water content of the covering soil on the side slope 50 is increased, and the covering soil surrounding the reinforcing frameworks 30 and the connecting pieces 20 becomes wet due to the increment of the water content, so that the tightness of combination of the covering soil with the reinforcing frameworks 30 and the connecting pieces 20 is increased, the covering soil does not easily slip from the reinforcing frameworks 30 and the connecting pieces 20, and the phenomenon that the covering soil on the side slope 50 slips when it is rainy can be effectively avoided.

As shown in FIG. 1, it can be understood by the skilled in the art to which the present application belongs that, in an implementation of the present application, a spacing distance of the connecting pieces 20 in the vertical direction is 0.4-0.8 m. Thus, the effect of connection among the reinforcing frameworks 30, the connecting pieces 20, the tank body 10, the covering soil near the connecting pieces 20 and the covering soil near the reinforcing frameworks 30 is guaranteed.

Figure 3:
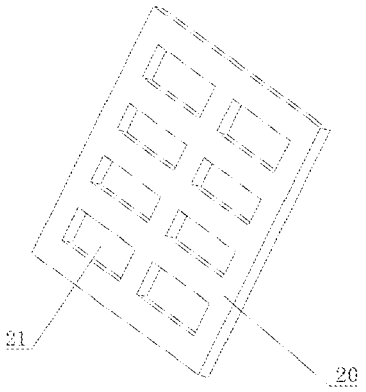
FIG. 3 is a schematic structural view of an exemplary implementation of a steel-plastic geogrid in the present application.

FIG. 3 is a schematic structural view of an exemplary implementation of steel-plastic geogrids in the present application. As shown in FIG. 3, in an implementation of the present application, the connecting pieces 20 are set as steel-plastic geogrids.

In the present application, the connecting piece 20 is a steel plastic geogrid, so that the connecting pieces 20 can resist to corrosive effects of water and chemical elements from the covering soil on the connecting pieces 20, the situation that the fixing effects of the connecting pieces 20 on the reinforcing frameworks 30 are lowered due to the fracture of the connecting pieces 20 is avoided, and meanwhile, the effect of connection between each connecting piece 20 and the covering soil is prevented from being lowered. The steel-plastic geogrids are of porous structures, and holes in the steel-plastic geogrids are the matching holes 21, so that the extension rods 31 of the reinforcing frameworks 30 are more easily combined with the connecting pieces 20, then, the construction difficulty is lowered, and the production efficiency is increased. The plurality of layers of steel-plastic geogrids arranged in the vertical direction may also effectively prevent a soil layer of the covering soil from sinking, prevent the covering soil from slipping and have an effect in fixing the covering soil, thereby improving the stability of the covering soil and avoiding the phenomenon that the stability of the tank body 10 is destroyed due to the slip of the covering soil. The steel-plastic geogrids have certain rigidity, are little in deformation and are capable of resisting to the action of a force given by the covering soil to a certain extent and playing a role in bearing the covering soil to a certain extent, thereby avoiding the problem that the covering soil on the side slope 50 slips due to the problem such as excessively high internal deformation or partial vacancy of the covering soil on the side slope 50.

As shown in FIG. 1, it can be understood by the skilled in the art to which the present application belongs that, in an implementation of the present application, a plurality of fixing pieces are arranged on the outer wall of the tank body 10, and the fixing pieces are used to be connected to the connecting pieces 20; and the fixing pieces are arranged to be single-layer at intervals around the outer wall of the tank body 10 and are arranged to be multi-layer at intervals in the vertical direction of the outer wall of the tank body 10.

In the present application, the single layer of fixing pieces is arranged at intervals around the outer wall of the tank body 10, a plurality of layers of fixing pieces are arranged at intervals in the vertical direction of the outer wall of the tank body 10, and connections between the reinforcing frameworks 30 and the connecting pieces 20 are gathered to the tank body 10 in the vertical direction, so that the tightness of connection between the tank body 10 and the covering soil can be increased, the covering soil is fixed under the combined action of the tank body 10, the connecting pieces 20, and the reinforcing frameworks 30, and then, the phenomenon that the side slope 50 slips is avoided. Moreover, the stability of the tank body 10 can be improved in this implementation. When the tank body 10 tends to be inclined, the combined action of the covering soil, the reinforcing frameworks 30 and the connecting pieces 20 can help the tank body 10 maintain the stability, and thus, the problems about environment pollution and production safety caused by the overturning of the tank body 10 are avoided.

As shown in FIG. 1, in an implementation of the present application, the fixing piece is a pothook 40, and the pothook 40 penetrate through the gap among the ribs of the connecting pieces 20.

In the present application, by arranging the pothooks 40, the pothooks 40 are connected by penetrating through the gaps among the ribs of the connecting pieces 20, so that the construction difficulty can be lowered, the labor intensity of workers can be relieved, and then, the construction efficiency can be increased. The connection between each pothook 40 and the outer wall of the tank body 10 is simple, so that the production efficiency can be increased. During construction, the connection between each connecting piece 20 and the tank body 10 can be accelerated, and thus, the production efficiency is increased.

Figure 2:
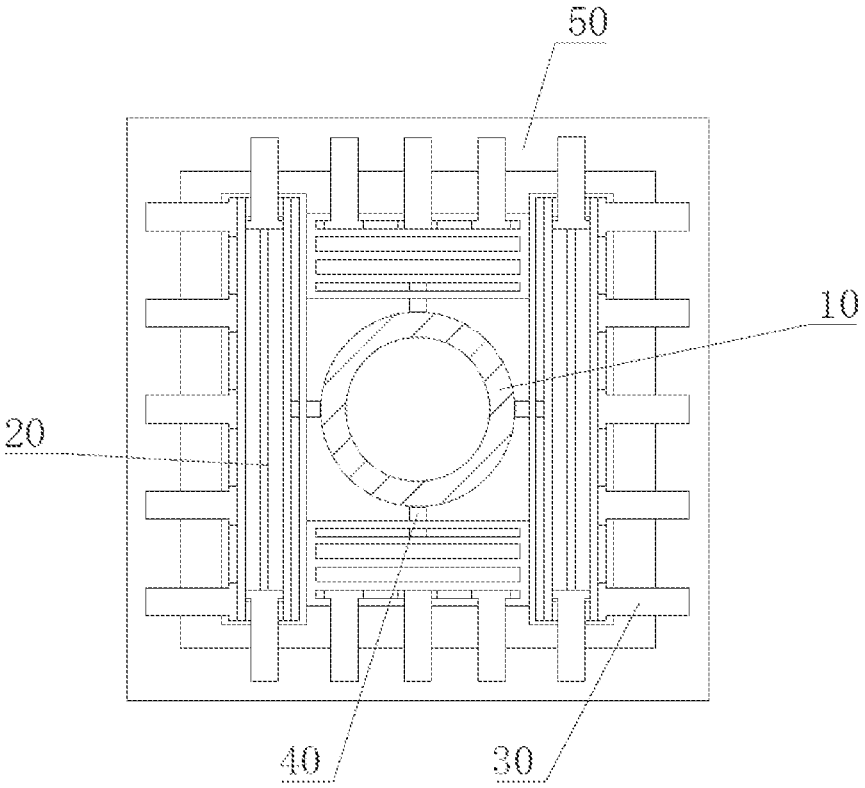
FIG. 2 is a schematic structural view of an exemplary implementation achieved when a single-layer connecting net is formed in the present application.

As shown in FIG. 2, in an implementation of the present application, the steel-plastic geogrids are in mutually-bound connection to form the single-layer connecting net around the tank body 10.

In the present application, due to the mutually-bound connection among the steel-plastic geogrids, the tightness of connection among the plurality of steel-plastic geogrids located on the same horizontal plane is enhanced, then, a force borne by one of the steel-plastic geogrids can be shared by the whole of the single-layer connecting net, and a load on the single steel plastic geogrid is reduced, so that the service life of the single steel plastic geogrid is prolonged, and later maintenance difficulty is avoided. Therefore, by adopting the way that the single-layer connecting net is formed around the tank body 10, the tank body 10, the steel-plastic geogrids and the reinforcing frameworks 30 which are located on the same horizontal plane can form an integral structure, so that the tightness of connection of the covering soil with the steel-plastic geogrids and the reinforcing frameworks 30 is enhanced; the covering soil near the single-layer connecting net located on the same horizontal plane becomes an integral structure, so that the effect on tightening the covering soil can be enhanced, the stability of connection between the covering soil and the tank body 10 is enhanced, and the effect that the stability of the tank body 10 is maintained by the covering soil is enhanced; moreover, the covering soil is more tightly connected to the tank body 10, so that the effect that the tank body 10 is protected by the covering soil can be enhanced; and the covering soil prevents the tank body 10 from being destroyed by external factors such as impact, and thus, production safety is guaranteed.

Figure 4:
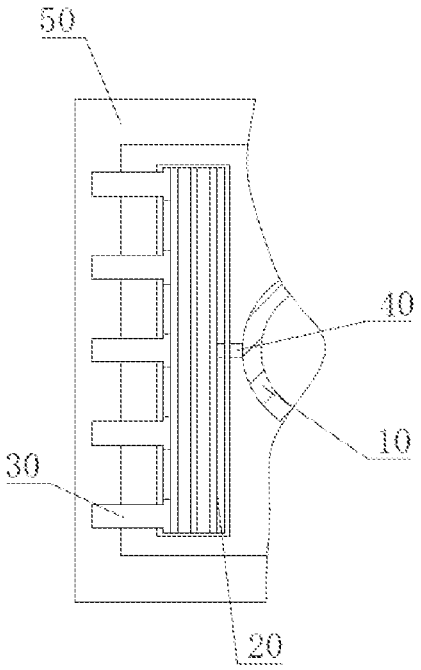
FIG. 4 is a schematic structural view of an exemplary implementation achieved when a matching hole is defined by ribs in the present application.

FIG. 4 is a schematic structural view of an exemplary implementation achieved when a matching hole is defined by ribs in the present application. As shown in FIG. 4, in an implementation of the present application, the matching hole 21 is defined by crossing the ribs of each connecting piece 20 so that the extension rod 31 of each reinforcing framework 30 penetrates among the ribs of the connecting piece 20.

The extension rod 31 penetrates among the ribs of each connecting piece 20, by which the labor intensity of constructors can be relieved, the construction difficulty can be lowered, and thus, the production efficiency is increased.

Figure 5:
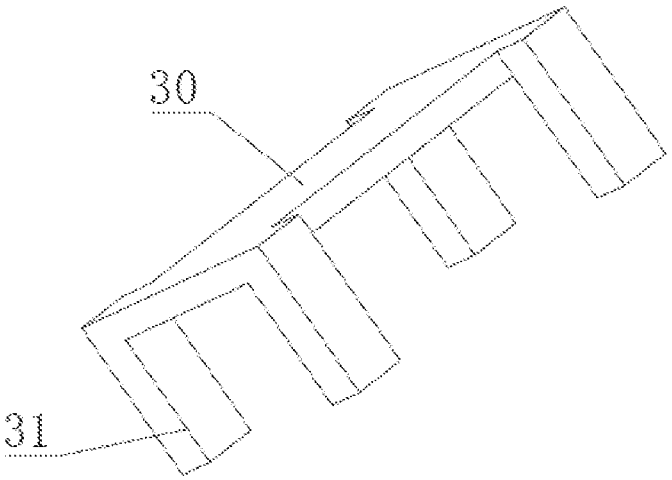
FIG. 5 is a schematic structural view of an exemplary implementation of a reinforcing framework in the present application.

FIG. 5 is a schematic structural view of an exemplary implementation of a reinforcing framework in the present application. As shown in FIG. 1 and FIG. 5, in an implementation of the present application, the extension rod 31 and the reinforcing framework 30 are arranged at a 90° included angle, the side slope 50 has a first inclination angle, and after the reinforcing framework 30 is arranged on the side slope 50, the extension rod 31 is inserted into the soil layer, so that an oblique insertion connection state is formed among the extension rod 31, the soil layer, and the connecting piece 20.

In the present application, by arranging the extension rod 31 and the reinforcing framework 30 at the 90° included angle, the difficulty in inserting the extension rod 31 into the covering soil can be lowered, the extension rod 31 can be inserted into the covering soil more simply, and thus, the construction difficulty is lowered. The side slope 50 has the first inclination angle, and after the reinforcing framework 30 is arranged on the side slope 50, the extension rod 31 is inserted into the soil layer, so that the oblique insertion connection state is formed among the extension rod 31, the soil layer, and the connecting piece 20, in this way, the tightness of connection among the reinforcing framework 30, the extension rod 31 and the covering soil can be increased, and thus, the covering soil is prevented from sinking.

As shown in FIG. 1 and FIG. 2, in an implementation of the present application, a plurality of the reinforcing frameworks 30 are arranged and are uniformly distributed at intervals in the horizontal and height directions of the side slope 50 respectively, so that the extension rod 31 of the single reinforcing framework 30 at least penetrates through the connecting piece 20 of the single-layer connecting net.

By adopting the way that the plurality of reinforcing frameworks 30 are arranged and are uniformly distributed at intervals in the horizontal and height directions of the side slope 50 respectively, the tightness of combination between the reinforcing framework 30 and the covering soil on the side slope 50 can be increased, the coverage area is increased, and the situation that the tank body 10 is corroded since the covering soil on the side slope 50 slips is avoided. By adopting the way that the extension rod 31 of the single reinforcing framework 30 at least penetrates through the connecting piece 20 of the single-layer connecting net, the tightness of the reinforcing frameworks 30 and the connecting pieces 20 can be increased, so that the effect that the connecting pieces 20 and the reinforcing frameworks 30 are combined with the covering soil can be improved, and the covering soil is prevented from slipping or collapsing.

Figure 6:
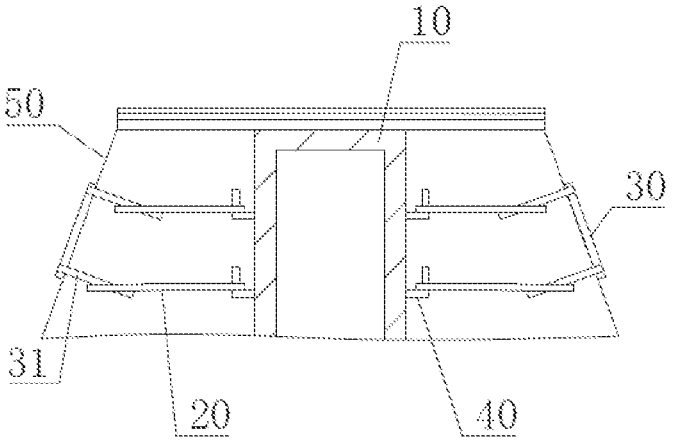
FIG. 6 is a schematic structural view of an exemplary implementation achieved when the reinforcing frameworks are connected to two layers of connecting pieces in the present application.

FIG. 6 is a schematic structural view of an exemplary implementation achieved when the reinforcing frameworks are connected to two layers of connecting pieces in the present application. As shown in FIG. 5 and FIG. 6, in an implementation of the present application, each of the reinforcing frameworks 30 is provided with four extension rods 31 which are symmetrically arranged around the reinforcing framework 30 respectively, the reinforcing framework 30 is arranged on the side slope 50, the two extension rods 31 arranged on an upper part of the reinforcing framework 30 penetrate through the connecting piece 20 on one layer, and the two extension rods 31 arranged on a lower part of the reinforcing framework 30 penetrate through the connecting piece 20 on the other layer, so that the same reinforcing framework 30 is connectable to two layers of connecting pieces 20 at the same time.

In the present application, the connecting pieces 20 which are spaced from each other in the vertical direction are connected by the extension rods 31 connected to one reinforcing framework 30, so that the covering soil between the two layers of connecting pieces 20 can form a whole, and the effect that the covering soil is consolidated by the connecting pieces 20 is enhanced. Each connecting piece 20 is composed of the ribs, so that the covering soil between the two connecting pieces 20 is still connected to the covering soil in other parts via the gaps among the ribs, so that the integral effect of the reinforcing frameworks 30, the connecting pieces 20, the covering soil and the tank body 10 is improved, the effect that the tank body 10 is fixed by the covering soil is improved, the tank body 10 is prevented from being overturned, and meanwhile, the relationship of connection between the tank body 10 and the covering soil is enhanced. A connecting structure between each reinforcing framework 30 and each connecting piece 20 and a connecting structure among each connecting piece 20, each reinforcing framework 30 and the tank body 10 have the effects of consolidating the covering soil and preventing the covering soil on the side slope 50 from slipping.

The above descriptions are only implementations of the present application and are not intended to limit the present application. Various modifications and changes will occur for those skilled in the art. Any modifications, equivalents, improvements, etc. that come within the spirit and principle of the present application are intended to be included within the protection scope of the present application.

What is claimed is:

1. An integral side slope structure of a soil-covered tank, comprising:

a tank body, an exterior of the tank body being completely covered with soil, and a side slope being formed after the tank body is covered with the soil; and connecting pieces, each connecting piece being composed of ribs which are in cross connection to each other; the connecting pieces being connected to an outer wall of the tank body and being laid inside the side slope in the horizontal direction; a single-layer connecting net being formed after a single layer of the connecting pieces is connected to the tank body; a plurality of the single layers of the connecting pieces being arranged at intervals in the vertical direction, so that a multi-layer connecting net connected to the tank body is formed in the side slope; the tank body and the side slope being connected by the multi-layer connecting net to form an integral structure; and reinforcing frameworks, the reinforcing frameworks being arranged along the side slope; a side wall of each reinforcing framework being provided with an extension rod; the extension rod extending and being inserted into the side slope; the connecting piece close to the reinforcing framework being provided with a matching hole; and the extension rod penetrating through the matching hole of the connecting piece, so that a cross structure is formed between the side slope and the connecting piece, the matching hole is defined by crossing the ribs of each connecting piece so that the extension rod of each reinforcing framework penetrates among the ribs of the connecting piece; the extension rod and the reinforcing framework are arranged at a 90° included angle, the side slope has a first inclination angle, and the reinforcing framework is arranged on the side slope, the extension rod is inserted into a soil layer, so that an oblique insertion connection state is formed among the extension rod, the soil layer, and the connecting pieces.

2. The integral side slope structure of the soil-covered tank of claim 1, wherein a spacing distance of the connecting pieces in the vertical direction is 0.4-0.8 m.

3. The integral side slope structure of the soil-covered tank of claim 2, wherein the connecting pieces are set as a steel-plastic geogrids.

4. The integral side slope structure of the soil-covered tank of claim 1, wherein the connecting pieces are set as steel-plastic geogrids.

5. The integral side slope structure of the soil-covered tank of claim 4, wherein the steel-plastic geogrids are in mutually-bound connection to form the single-layer connecting net around the tank body.

6. The integral side slope structure of the soil-covered tank of claim 1, wherein a plurality of fixing pieces are arranged on the outer wall of the tank body, and the fixing pieces are used to be connected to the connecting pieces; and the fixing pieces are arranged to be single-layer at intervals around the outer wall of the tank body and are arranged to be multi-layer at intervals in the vertical direction of the outer wall of the tank body.

7. The integral side slope structure of the soil-covered tank of claim 6, wherein the fixing piece is a pothook, and the pothook penetrate through a gap among the ribs of the connecting pieces.

8. The integral side slope structure of the soil-covered tank of claim 1, wherein a plurality of the reinforcing frameworks are arranged and are uniformly distributed at intervals in the horizontal and height directions of the side slope respectively, so that the extension rod of the single reinforcing framework at least penetrates through the connecting piece of the single-layer connecting net.

9. The integral side slope structure of the soil-covered tank of claim 8, wherein each of the reinforcing frameworks is provided with four extension rods which are symmetrically arranged around the reinforcing framework respectively, the reinforcing framework is arranged on the side slope, the two extension rods arranged on an upper part of the reinforcing framework penetrate through the connecting piece on one layer, and the two extension rods arranged on a lower part of the reinforcing framework penetrate through the connecting piece on the other layer, so that the same reinforcing framework is connectable to two layers of connecting pieces at the same time.

* * * * *